United States Patent [19]

Tanaka

[11] 4,050,272

[45] Sept. 27, 1977

[54] LOCK ASSEMBLY

[75] Inventor: Hiroshi Tanaka, Yoro, Japan

[73] Assignee: K.K. Tokai Rika Denki Seisakusho, Japan

[21] Appl. No.: 685,895

[22] Filed: May 12, 1976

[30] Foreign Application Priority Data

May 20, 1975 Japan ..... 50-67459[U]

[51] Int. Cl.[2] ..... E05B 65/08

[52] U.S. Cl. ..... 70/100; 70/137; 292/26; 292/DIG. 46

[58] Field of Search ..... 70/100, 123, 137, 139, 70/448; 292/25, 26, 96, 97, 106, 337, DIG. 46

[56] References Cited

U.S. PATENT DOCUMENTS

| | | | |
|---|---|---|---|
| 2,736,185 | 2/1956 | Collar | 70/137 X |
| 2,924,475 | 2/1960 | Russell | 70/100 X |
| 3,019,043 | 1/1962 | Woodworth et al. | 70/100 X |
| 3,368,374 | 2/1968 | Eads | 70/100 |
| 3,884,056 | 5/1975 | East | 70/100 |
| 3,899,201 | 8/1975 | Paioletti | 70/100 X |

FOREIGN PATENT DOCUMENTS

| | | | |
|---|---|---|---|
| 2,152,199 | 4/1973 | Germany | 70/137 |
| 583,879 | 10/1958 | Italy | 70/100 |

*Primary Examiner*—J. Franklin Foss
*Attorney, Agent, or Firm*—Spensley, Horn and Lubitz

[57] ABSTRACT

A lock assembly having special utility for locking sliding doors and the like is disclosed. The lock assembly comprises a cylinder lock having a rotor case and a rotatable rotor disposed therein. The rotor has pin members configured such that upon insertion of an associated key into the rotor, the pin members retract and the rotor is rendered selectively rotatable in the rotor case. A movable runner is coupled to the rotor and a hook member is coupled to the runner such that when the runner is moved from the unlocked position to the locked position, the hook moves into a "deadlock" zone. A driver member is also connected to the runner to aid it in moving from its locked position to the unlocked position and vice versa.

5 Claims, 19 Drawing Figures

LOCK ASSEMBLY

BACKGROUND OF THE INVENTION

1. Field of the Invention

The present invention relates to a lock assembly, and more particularly, to a lock assembly having a hook suited for sliding doors.

2. Prior Art

The use of sliding doors is well known in the art. However, the lock used on such sliding doors have tended to be rather fragile compared to the type of lock found in most hinged doors. One reason for this fact is that in contrast to a hinged door, the frame of a sliding door is small and it is thus difficult to employ cylinder locks. The most common type of lock which has been used in sliding doors is a plate-key type twist lock system which is unsophisticated and can be easily unlocked by the insertion of any small key-like implement.

In recent times, aluminum sash has become widely used in sliding doors which has resulted in allowing the use of the cylinder-type locks with a hook on such doors. There are two forms that are commonly used. In the case of the first one, the inner and outer fasteners are attached, whereas bifacial fastenings are used with the second.

In the first, since the outer fastening and inner fastening are built with completely incompatible systems, they are in no way related to one another. Accordingly, this means that if the door is locked from the inside, it cannot be opened from the outside and if locked from the outside, it cannot be unlocked from the inside. In terms of security, this method is thought to be the most certain, but it is inconvenient. The above-mentioned plate-key type of twist lock is a good example of this style. The truth is that a really secure product is not yet on the market.

The second is locked and unlocked from the outside by means of a cylinder lock and from the inside by a thumb knob, thus the locking and unlocking operation from both the inside and the outside is the same. Since this is identical to the locking and unlocking method used with hinged doors, this system is considered superior in terms of its convenience and can save substantial time. However, such a system has a significant shortcoming in that since the dimensions of a door frame of a sliding door are restricted, the number of cylinder pins must be limited for the sake of greater convenience. This means that the locking device is substantially simple; thus it is easy to pick so as to gain entry.

BRIEF SUMMARY OF THE INVENTION

This invention has been developed in an attempt to solve the above-mentioned shortcomings of the prior art. The lock structure of this invention employs an ultra-thin type cylinder of high reliability which has a greater number of tumblers by radially distributing them circumferentially about a key opening rather than by placing them in a single row as in the prior art. The lock structure further comprises a movable runner coupled to a rotor, a rotatable hook member coupled to the runner, and a driving means, whereby the hook member rotates into the locked or unlocked position when the rotor is actuated to cause the runner to move, and the driving means independently controls the rotation of the hook member.

Accordingly, the primary object of this invention is to provide a hook-type cylinder lock structure which is so securely and compactly designed as to be suited for locking sliding doors.

Many other objects and purposes of this invention will become clear from the following detailed description when read in conjunction with the accompanying drawings.

DETAILED DESCRIPTION OF THE INVENTION

Figure 1:
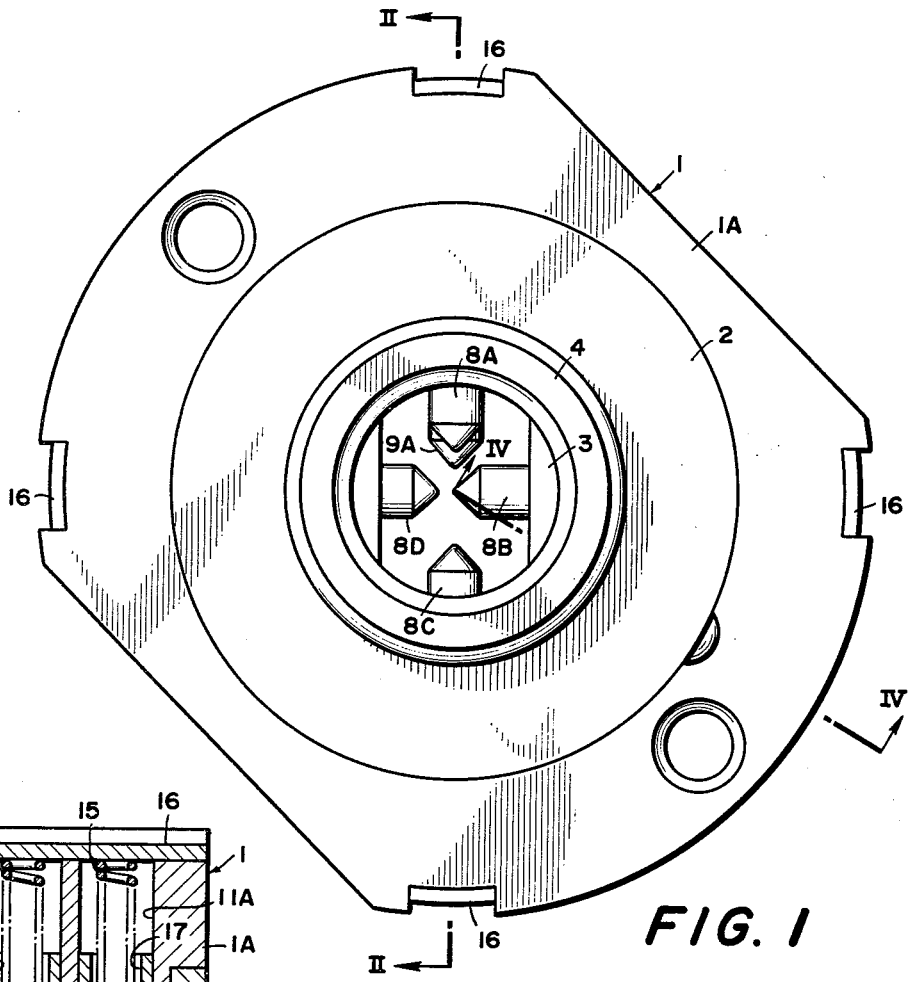
FIG. 1 is a front view of the thin cylinder lock of the present invention.
Figure 2:
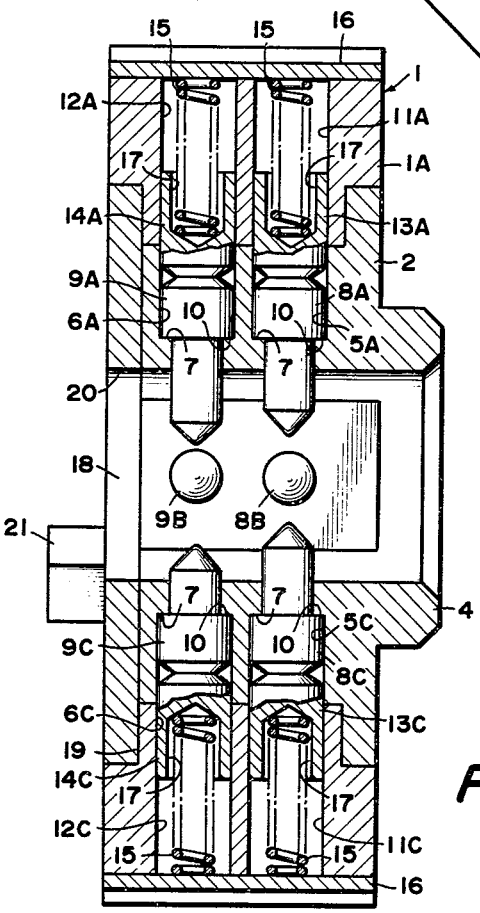
FIG. 2 is a cross-section of the cylinder lock shown in FIG. 1 taken along line II—II showing the rotor and inwardly extending pin members.

Referring first to FIGS. 1 and 2, there is shown the cylinder lock 1 made up of a rotor case 1A having an annularly shaped rotor 2 disposed therein. The rotor 2 is positioned such that it can rotate in the rotor case 1A upon insertion of an associated key in a key opening 3 located axially in the rotor 2. A standing wall 4 is located at the periphery of the key opening 3 so as to guide the associated key upon insertion through the key opening 3 into the proper opening position. To encourage this action, the standing wall 4 is tapered such that the diameter adjacent the outer opening is larger than adjacent the back of the lock 1.

In the rotor 2 there are four circumferentially disposed slide holes 5A, 5B, 5C, and 5D which extend radially on the same plane. At the rear of each of these holes, there are four similar slide holes arranged likewise as numbered 6A, 6B, 6C, and 6D. At the mid-point of each of these holes is a ledge 7. As a result, the inner end portion of each of the holes 5A–5D and 6A–6D is formed diametrically reduced. In each of these holes pick pins 8A, 8B, 8C, and 8D and 9A, 9B, 9C, and 9D are inserted and move freely, the head of each pick pin projecting into the key opening 3. In the middle of each pick pins 8A–8D and 9A–9D is formed a ledge 10. This ledge 10 is in contact with the ledge member 7 of each of the slide ports 5A–5D and 6A–6D. At the point of contact of each of the ledges 7 and 10, each of the pick pins is held in slidable position. Moreover, the relationship of the ledges 7 and 10 prevents the pick pins from falling through into the key opening 3. The length of each of the pins is varied such that only a particularly associated key will cause the pin members to be retracted into the rotor case 1 thereby causing the rotor 2 to rotate. On the inner surface of the rotor case 1A is drilled slide ports 11A, 11B, 11C, 11D, and 12A, 12B, 12C, and 12D which are connected to the slide ports 5A–5D and 6A–6D in the rotor 2. Lock pins 13A, 13B, 13C, 13D, and 14A, 14B, 14C and 14D can freely penetrate each of the slide ports such that the front of each lock pins 13A–13D and 14A–14D is in contact with the rear of pick pins 8A–8D and 9A–9D. Each of the lock pins is forced forward by springs 15 such that the pick pins are caused to extend to the key opening 3. The rear of the spring 15 is supported by a spring cover 16 and the head of the spring 15 fits into a cylindrical concave portion 17 of the pick pins. Because of the concave portion 17, the coupling length of the springs 15 and the lock pins is made to be of minimum length further reducing the overall diameter of the rotor case 1A.

Figure 3:
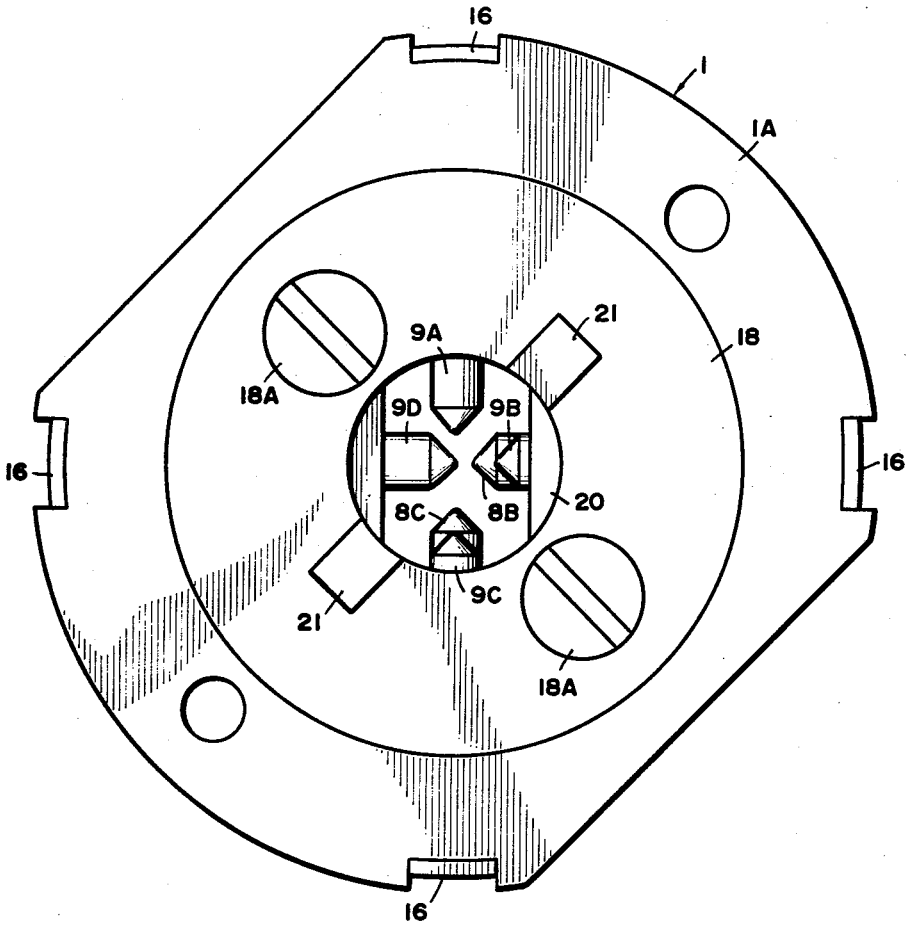
FIG. 3 is a rear view of the lock of FIG. 1.
Figure 4:
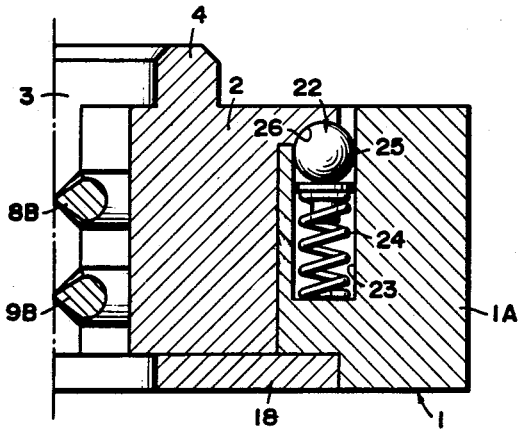
FIG. 4 is a cross-sectional view of the lock shown in FIG. 1 taken along line IV—IV and showing an associated clip ball.

Referring now to FIG. 3, a stopper plate 18 is fastened to the back of the rotor 2 by screw members 18A. This stopper plate 18 is constructed so that it can rotate freely within the concave portion 19 of the rotor case 1A. Accordingly, the stopper plate 18 rotates when the rotor 2 is rotated. This stopper plate 18 has an opening 20 at its center and a cylindrical cam 21 projects out from the face of the stopper plate 18. The cylindrical cam 21 interacts with a cam 45 discussed hereinbelow and rotates it in the process of locking and unlocking the lock assembly. In FIG. 4, the rotor case 1A is shown with an associated click system 22. By means of this click system 22 the rotor can be secured in a fixed position. The fixed position is referred to herein as a key withdrawal position. That is to say, there is a hole 23 in rotor case 1A which contains a click spring 24 and a click ball 25. The click ball 25 is positioned at the upper end of the click spring 24 and is forced upward and caught in the depression 26 in the rotor 2. The click ball 25 when disposed in the depression 26 prevents undesirable rotation of the rotor member 2. Of course, rotation of the rotor 2 is further prevented because the lock pins (FIG. 2) would be positioned across the joint between the rotor 2 and the rotor case 1A.

The rotor case 1A of this invention may be constructed very compactly. In this embodiment, for example, the diameter of the rotor case is 28 mm and its thickness is 8 mm.

Referring now to FIGS. 5 through 14, the working action of the lock design of the present invention is shown.

Figure 7:
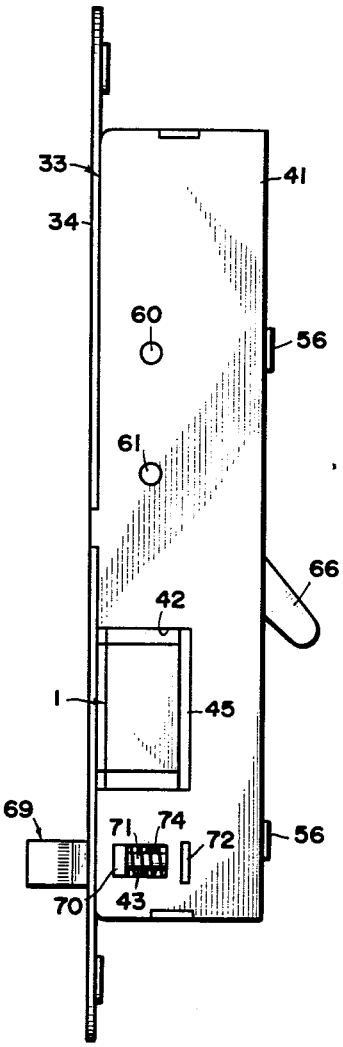
FIG. 7 is a side view of the lock assembly of the present invention.
Figure 8:
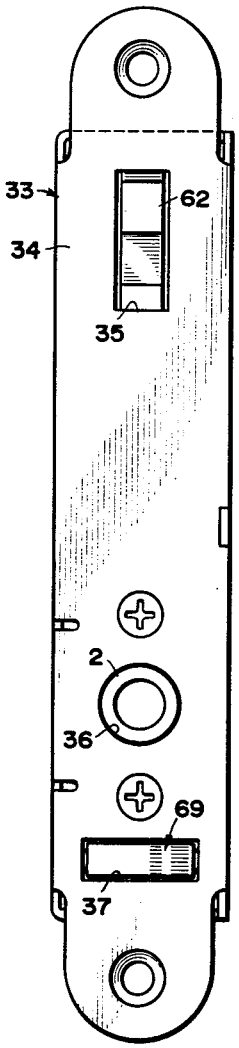
FIG. 8 is a front view of the lock system.

A lock case 33 of the lock itself is secured by screws to the front plate 32 of a typical sliding door's interior sash 31 (see FIGS. 7 and 8). This casing 33 is made of a sheet of iron or steel bent into the shape of a box forming a hole 35 for the hook projection which has been drilled in the upper part of the front plate 34 of the casing 33 as well as an insertion hole 36 at its lower end for the standing wall 4 and a hole 37 for the trigger connection of the aforementioned cylinder lock 1.

Also, at the center of the rear plate 38 of the aforementioned casing 33, holes 39 for the thumb rotating bar slide have been drilled. Likewise, holes 40 for the runner guides are drilled in the upper part of one side and the lower part of the other side. Finally, an engaging or stopper port 42 for the cylinder lock 1 and the trigger guide slot 43 are drilled at the bottom of both side plates 41.

The rotor case 1A of the rotor lock 1 is secured by screws 44 to the front plate 34 of the casing 33. The butterfly channel 46 of the disc-shaped cam 45 is connected to the cylinder cam 21 of the stopper plate 18 of the cylinder lock 1 (see FIGS. 11 and 12). The cylinder cam 21 is arranged and configured such that it can rotate unhampered 90° in the butterfly slot 46. When it rotates more than 90° in one direction, the cam 45 is caused to be engaged and thus rotates in the same direction. In other words, rotation of the cylinder cam 21 beyond the 90° will cause the cam 45 to rotate in the same direction of rotation as the cylinder cam 21.

The cam 45 has a cam pin 47 in its eccentric position with one end of cam pin protruding from the bottom plate 49 of the runner 48, which is slidably received in the case 33.

The runner 48 has roughly the shape of a squarish U in cross section and the bottom plate 49 is found only at the lower half of the runner 48. At the center of the bottom plate 49 is a long slot or groove 50. The lower part of groove 50 takes the form of a round groove or opening 51. A U-shaped hole 52 is drilled at the side of the central section of the bottom plate 49 such that the above-mentioned cam pin 47 runs through this U-shaped hole 52. Between the cam pin projection 47 and the raised piece 53 which is set on the floor plate 49, a spring 54 is held under tension and is linked with the rotation of the cam 46. In this manner, the runner 48 is enabled to slide smoothly in upward and downward directions. At the upper back of one of the slide plates 55 of the runner 48 and the lower back of the opposed slide plate 55, the runner guides 56 project and correspond to the runner guide ports 40 in the above-mentioned case 33 and are thus coupled together with them.

At that portion of the side plate 55 without the floor plate 49, that is, the front upper half, there are located in descending order, a cutaway area 57 for a deadlock pin 63, a spring braking ward 58 which is bent inwards, and a cutaway area 59 for a slide pin 67. The aforementioned cutaway 57 for the deadlock pin 63 is formed in two sections; there are the dead channel 57A shown most clearly with reference to FIGS. 13 and 14, and the free-zone channel 57B in the deadlock channel 57A.

Toward the front of the above-mentioned side plates 55 a shaft 60 for the hook is located. A shaft 61 is also provided for the thumb turn with the shafts 60 and 61 sandwiched between the side plate 41 of the case 33. One end of the squarish U-shaped hook 62 is supported axially at the shaft 60 and rotates thereabout. Near the end of this hook 62, the deadlock pin 63 protrudes on both sides of the hook 62. The deadlock pin 63 is joined with the notch 57 used for the deadlock pin, which is set in the side plates 55 of the above-mentioned runner 48. The other end of the hook 62 faces the crescent ward port built into the forward plate 34 of the case 33, and in concert with the upward motion of the runner 48 projects and revolves roughly 90° and is held by latch port 65 of the exterior sash.

While one end of the thumb bar 66, which functions as a driver, rotates freely and is axially supported at the shaft 61, the slide pin 67 is constructed so that it projects at both sides of the center of the thumb bar 66. This slide pin 67 joins with the notch 59 used for the slide pin, which is set in the side plate 55 of the runner 48.

The center of the screw coil spring 68 is held by the spring latch ward 58 of the side plate 55; one end 68A of the spring 68 is held by the deadlock pin 63 of the hook 62, the other end 68B is held by the slide pin 67 of the thumb bar 66. The movement of the runner 48, the thumb bar 66 and the hook 62 is thus rendered free and smooth because the spring 68 is caused to return to the original position after its use.

Figure 9:
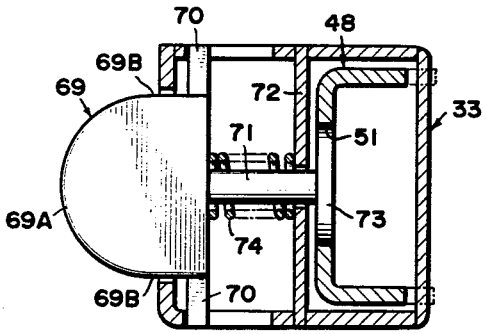
FIG. 9 is a top view of a part of the trigger mechanism.

The trigger 69 is disposed in the lock 1 so as to go from an extended to a retracted position from one end to the other in the trigger union port 37 which is positioned at the bottom of the front plate 34 of the case 33. In the case of the trigger 69, the protrusion 69A from the front plate 34 forms an arcuous member. Both sides 69B of the protrusion 69A are sheared flat, and at the rear, the trigger guide 70 protrudes on both sides as shown in FIG. 9. The trigger guide joins with the trigger guide port 43 which is built into the side plate 41 of the case 33 and serves to guide the back and forth movement of the trigger 69. A trigger pin 71 is built protruding at the back edge of the trigger 69 and slides freely through to the trigger support seat which spans the side plate 41 of the case 33. The disc-shaped trigger plate 73 is secured on the protrusion on the trigger support seat 72 of the trigger pin 71. A compression coil spring 74 is interposed between the trigger support seat 72 and the rear edge of the trigger 69. The trigger 69 is forced in the direction of the protrusion, the trigger plate 73 joins with the round channel 51 in axial alignment. Channel 51 being disposed in the bottom plate 49 of the runner 48. In this position, upward motion of the runner 48 is prevented.

Reference numeral 75 designate the back face plate of the interior sash 31. Reference numeral 76 designates the thumb turn plate which is screwed into the back face plate 75 and numeral 77 shows the thumb turn bar protrusion hole built into the thumb turn plate 76. Reference numeral 78 shows the key insertion tube that passes through the exterior sash 64 and is in axial alignment with the opening 3 in the rotor 2.

The operation of the first embodiment of the lock of the present invention will now be described.

A key (not shown) is inserted into the key opening 3 of the cylinder lock 1, using the key insertion tube 78 located on the exterior sash 64. By means of each of the tumblers 8A–8D and 9A–9D, each of the lock pins 13A–13D and 14A–14D are pushed back and the contact surface is positioned on the slide surface of the rotor 2 and the rotor case 1A. By this manner, the joint between the rotor 2 and the rotor case 1A is permitted to move into a slidable configuration and the rotor 2 can now rotate. Under these conditions, when the key is turned, the rotor 2 rotates and, in conjunction with this, the cam 45 also rotates (refer to FIGS. 11 and 12). With the rotation of the cam 45 and by means of the slide pin 67 which is in contact through the operation of the spring 68 at the lower area of the slide pin notch 59 of the runner by means of the cam pin 47, the thumb turn bar 66 turns counter-clockwise (FIG. 5) around the thumb turn shaft 61 and moves into the position shown in FIG. 10. Moreover, the deadlock pin 63 which connects with the free-zone channel 57B of the deadlock pin notch 57 of the runner 48, through the operation of one end 68A of the spring 68, rotates in a counter-clockwise direction shown in FIG. 5 around the hook shaft 60. The hook 62 is thrust out from the hole 35 and the tip of the hook 62 is held in the latch port 65 of the exterior sash 64 and the locking action is achieved. Since the central axial pitch $P_B$ between the deadlock pin 63 and the crescent shaft 60 is made smaller at this juncture than the central axial pitch $P_S$ between the slide pin 67 and the thumb turn shaft 61, the upward displacement of the deadlock pin 63 is smaller than displacement of the slide pin 67. Accordingly, the deadlock pin 63 moves into the deadlock channel 57A which is linked on stage lower, to the free-zone channel 57B of the deadlock pin notch 57. The deadlock channel 57A at its bottom has an R section which is roughly the same as the outer circumference of the deadlock pin 63. The amount of displacement of the center of R and the center of the free-zone channel 57 is somewhat smaller than the difference between the above-mentioned central axial pitch $P_B$ and $P_S$, so the deadlock pin 63, when it moves upward, comes into contact with the lower area of the deadlock channel 57A and locks. (See FIGS. 13 and 14.) When the runner 48 rises to its highest position and the deadlock pin 63 is joined with the deadlock channel 57A, then, even though it attempts to turn the hook 62 in a clockwise direction, the runner 48 is not only pushed downward by the deadlock pin 63 it is also pushed to the rear. The result is that the runner 48, which in the case 33 is allowed only to slide in an upward and downward direction, cannot move. Thus, the crescent hook 62 is secured in the locked position.

In this locked position, when the key is given a reverse turn of 90°, the cylinder cam 21 does not cause the runner 48 to move in the butterfly channel 46 of the cam 45. It moves freely and one can easily withdraw the key.

When unlocking is effectuated, the key, by means of the key insertion tube 78, is again inserted into the key insertion hole 3 of the cylinder lock 1 and turned, as indicated above, in the opposite direction. The runner 48 then descends because of the cam 45 and the cam pin 47. In conjunction with this, the deadlock pin 63 of the hook 62 comes into contact with the upper part of the deadlock pin notch 57 and as it moves along this upper part to the free-zone channel 57 of the notch, it revolves clockwise around the hook shaft 60, returning to its former position, releasing the hold on the exterior sash 64 by the hook 62. In conjunction with descent of the runner 48, the thumb turn bar 66, also through the operation of the slide pin 67 and the slide pin notch 59, rotates clockwise around the thumb turn shaft 61 and returns to its former position. The functioning of the thumb turn bar 66 shall now be described.

Figure 5:
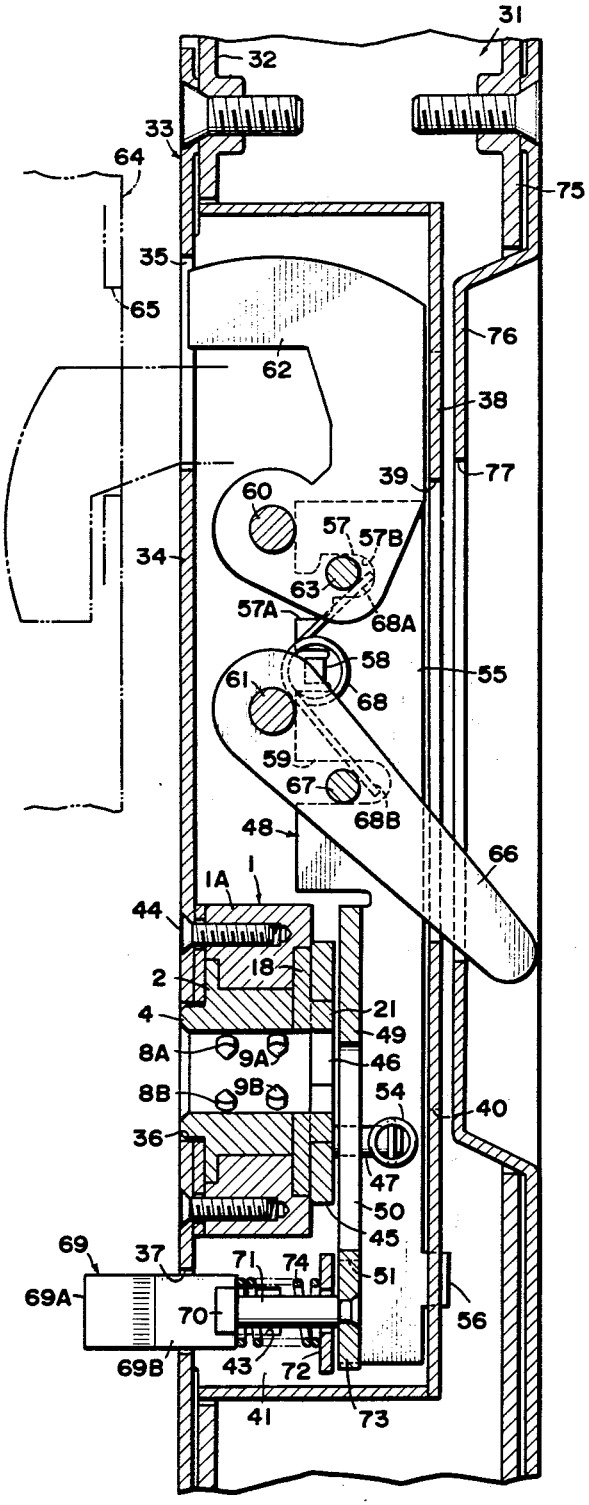
FIG. 5 is a vertical cross-sectional view of the first embodiment of the present locking system of this invention.
Figure 6:
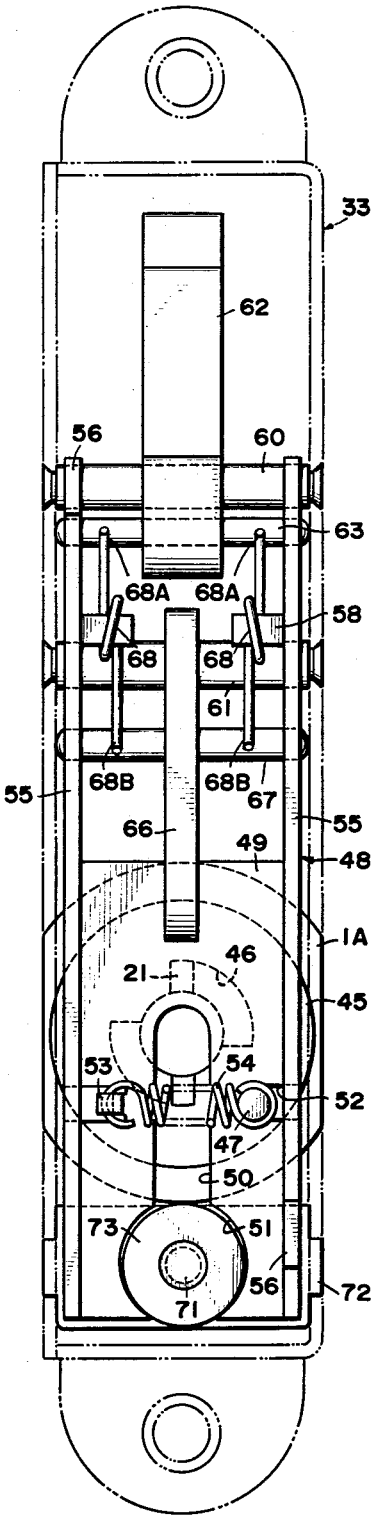
FIG. 6 is a front view of the locking system of the present invention.
Figure 10:
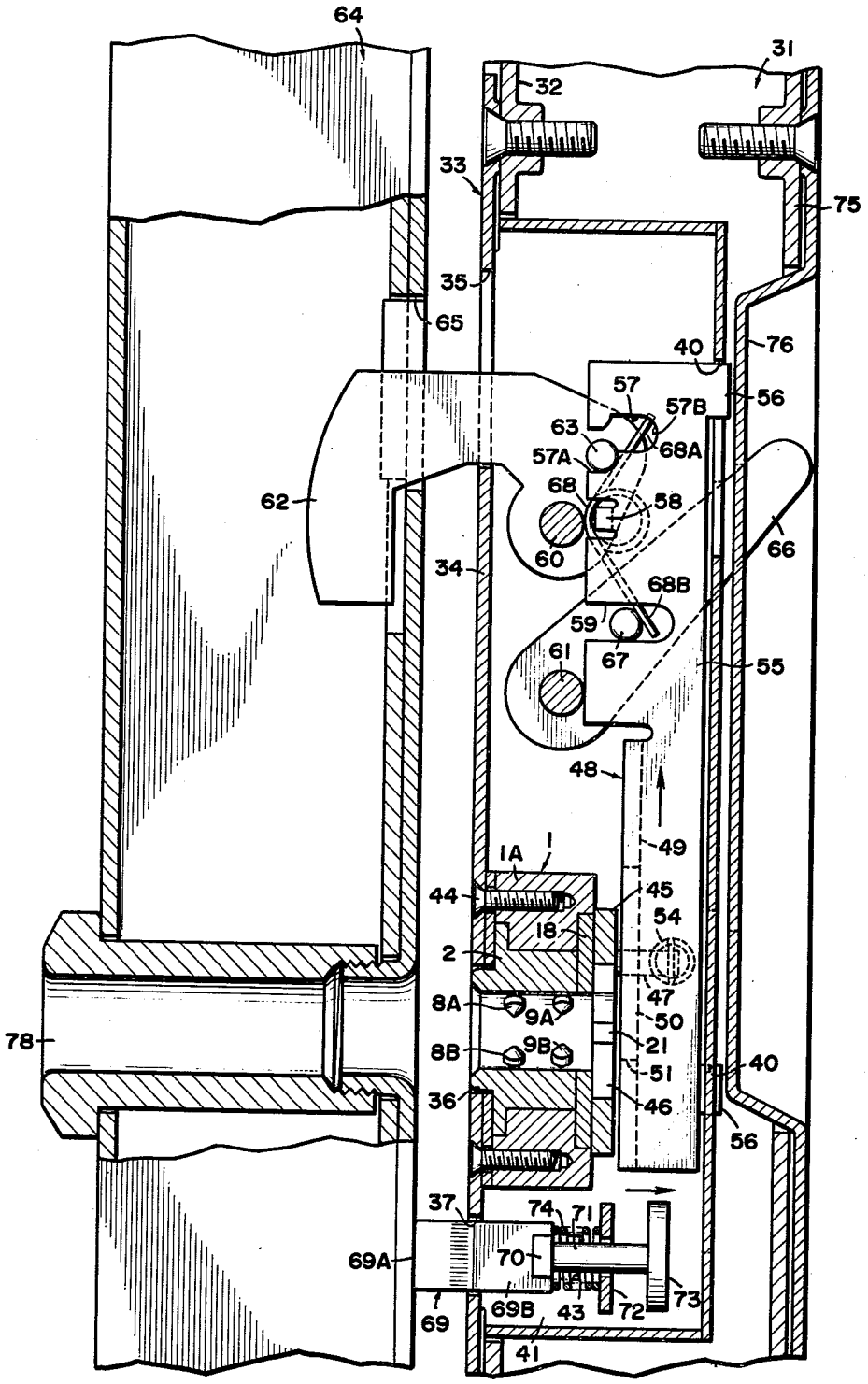
FIG. 10 is a vertical cross-sectional view of the lock in the locked position.
Figure 11:
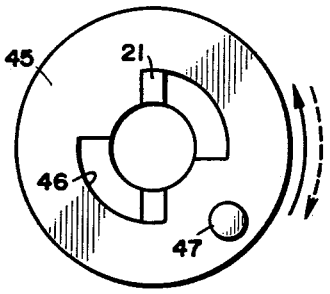
FIGS. 11 and 12 show the operation of the cam member of the present invention.
Figure 12:
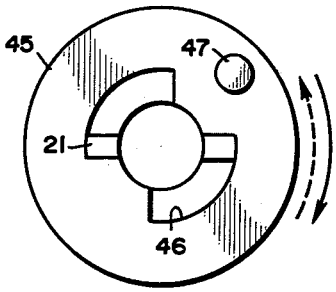
Figure 13:
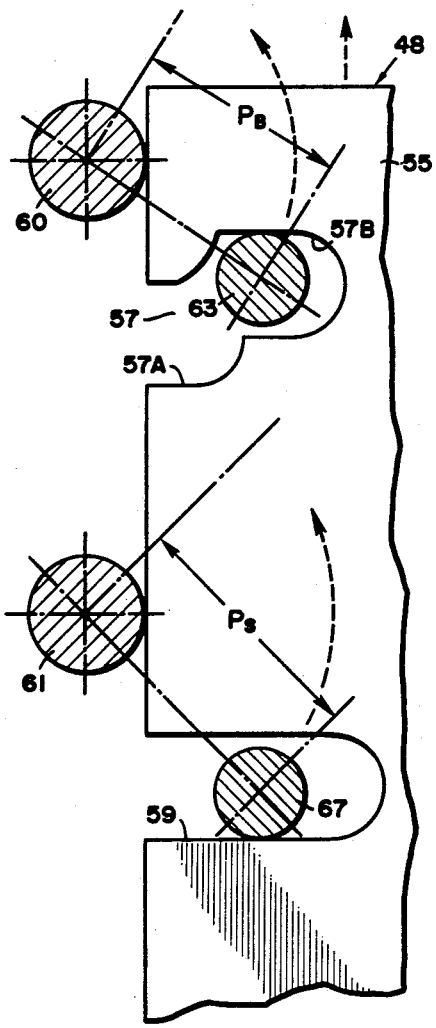
FIGS. 13 and 14 show the operation of the runner member of the present invention.
Figure 14:
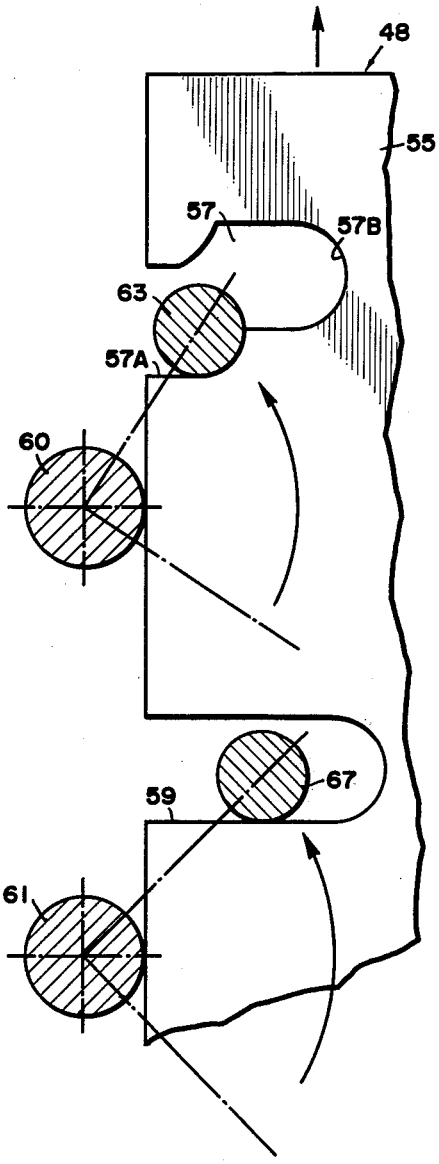
Figure 15:
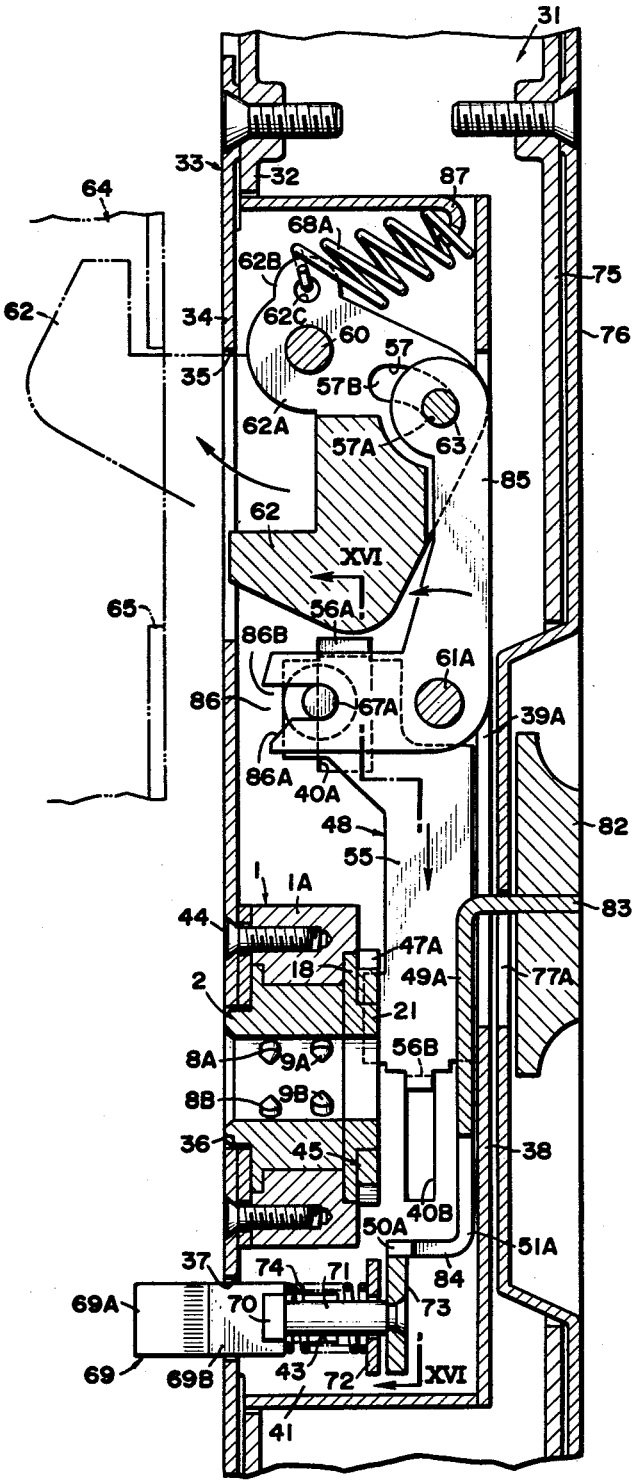
FIG. 15 is a vertical cross-sectional view of the second embodiment of the present invention.

At the inside of the interior sash 31, if one takes hold of the projection on the thumb turn plate 76 of the thumb turn bar 66 and rotates it counter-clockwise as shown in FIG. 5, the runner 48, through the action of the slide pin 67 and the slide pin notch 59, rises and, as in the case of the aforementioned key, the hook 62 holds the exterior sash 64 (see FIG. 10). If one now makes a reverse turn of the thumb turn bar 66 in the clockwise direction, the hold between the crescent and the exterior sash 64 is released.

The trigger 69 described hereinabove is a device to effectuate the unlocking mentioned above only in the event that the door frames of the outer sash 64 and the inner sash 31 have come together. When the interior and exterior sashes 31 and 64 are not together, that is, in the illustration shown in FIG. 5, the trigger 69, by means of the operation of the compressed coil spring 74, protrudes. The trigger plate 73 now presses into the circular channel 51 of the runner 48. Because of this, the upward motion of the runner 48 is prevented and is effectively blocked. When the interior and exterior sashes 31 and 64 are together, as shown in FIG. 10, the trigger 69 has its arched projection 69A in contact with the door frame of the exterior sash 64 and inserted into the inside sash 31 in opposition to the compressed coil spring 74. Thus, the trigger plate 73 slips out of the circular channel 51 and moves to the rear. The trigger pin 71 is situated in the circular channel 51 and as a consequence, the runner 48 can now move in an upward direction.

The second embodiment will be discussed herein with reference to FIG. 15 through 19. In the second embodiment of the present invention, a locking bar is interposed between the hook and the runner of the first embodiment discussed hereinabove. This has basically the same type of features as discussed hereinabove and at the same time achieves the driving of the thumb turn bar by means of a slide catch. Thus, the lock can be unlocked easily and the hook lock is made even more reliable. For the same or identical numbers discussed in the first embodiment, we have applied herein the same or related numbers and have not redescribed those elements performing the same function.

Figure 18:
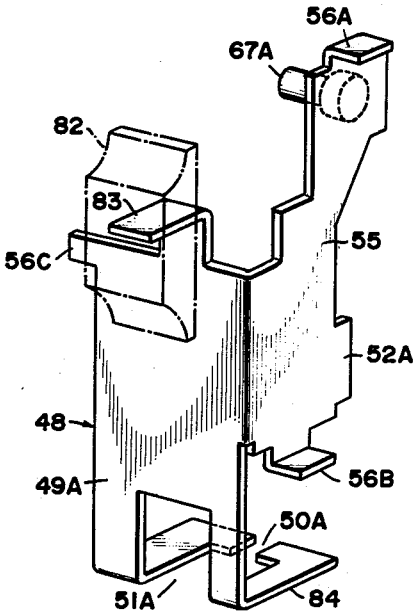
FIG. 18 is a side view of the runner of the second embodiment of the present invention.
Figure 19:
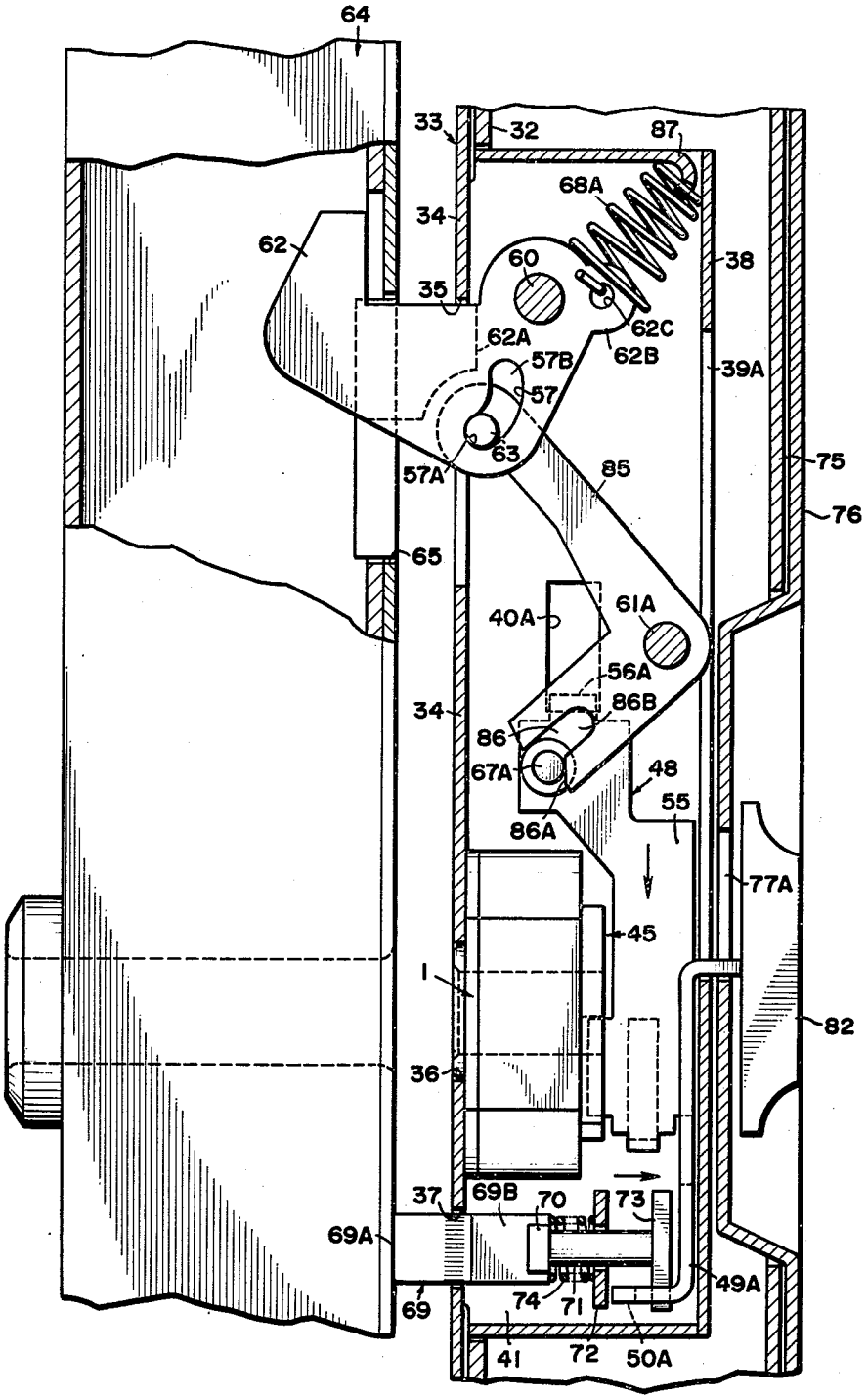
FIG. 19 is a vertical cross-sectional view of the second embodiment of the present invention in a locked position.

A cylinder lock 1 is attached to the lower part of the front plate 34 of the case 33 of the lock proper. The cam 45 is fixed at the stopper plate 18 of the cylinder lock 1 by a screw 81. The cam 45 has two horn-like projections 47A extending from its disc-like main section 45A with space between them. These projections 47A project above the same plane as the main section 45A and are in opposition to the holding ward 52A which projects from the side plate 55 of the runner 48 (see FIG. 16). The runner 48 as shown in FIG. 18 is bent into an L-shape, forming the side plate 55 and the guide plate 49A. The upper and lower tips of the side plate 55 are bent outward forming the runner guides 56A and 56B which fit into runner guide holes 40A and 40B in the side plate 41 of the case 33.

At the upper extremity of the side plate 55, a runner pin 67A projects which is of a larger diameter and faces the interior of the case 33. The above-mentioned holding ward 52A projects at the lower end of the opposite side of the guide plate 49A. At the upper end of the guide plate 49A is a bent piece 83 to which is attached the slide catch 82 which functions as a driver. The bent piece 83 projects from the slide port drilled into the back plate 38 of the case 33. The lower end is bent into the shape of a trigger plate holding piece 84 and is bent in the opposite direction to the above-mentioned bent piece 83. The tip of the trigger plate holding piece 84 is narrower than the horn-shaped trigger plate 73 and forms a kerf 50A wider than the trigger pin 71 and from the foundation to the bottom of the guide plate 49A there is a notch hole 51A wider than the horn-shaped trigger plate 73. Thus, only when the trigger plate 73 has moved to the rear can the runner 48 descend. At the upper end of the guide plate 49A a runner guide 56C projects on the opposite face of the side plate 55. This runner guide 56C fits into a runner guide hole 40C which is built into the side plate 41 and the side plate on the other side 41. Both have runner guide holes 40A and 40B for the case 33.

A lock bar shaft 61A is sandwiched between the side plates 41 at the middle of the rear side. The bent section of a locking bar 85, formed in somewhat of an L-shape, is supported so as to rotate freely by the shaft 61A. A runner pin notch 86 which fits into a runner pin 67 is located at one end of the locking bar 85, and at the other end is a projecting deadlock pin 63 which fits into the J-shaped deadlock pin notch of the hook 62 which is supported by the hook shaft so that it can rotate freely. The other end of the locking bar 85 at this point is positioned in the cut-out part 62A of the hook 62.

Further, there is a diagonally-cut deadlock zone 86A at the bottom of the entrance to the runner pin notch 86, and also a free zone 86B which is connected to the deadlock zone 86A. In addition, a free zone channel 57B is to be found at the side of the hook shaft 60 of the deadlock pin notch 57, connected to the deadlock zone channel 57A on the opposite side. On the base end of the hook 62 is a circular protrusion 62B having a hole 62C at its center. A coil spring 68A extends from the protrusion 62B to the top plate 87 of the case. Reference numeral 77A indicates the bent slide channel.

In this configuration, when the key is inserted and the rotor 2 of the cylinder lock 1 is rotated after the trigger plate 73 has been moved back, i.e., when the interior and exterior sashes are together, then the protrusion 47A on top of the cam 45 comes into contact with the upper part of the holding ward 52A of the runner 48, which is moved downward. As this is happening, the runner pin 67A presses the lower part of the runner pin notch 86 and rotates the locking bar 85 counterclockwise and pushes the cam 62 clockwise by means of the deadlock pin 63. The cam 62 is pushed from the cam protrusion hole 35 and holds the restraining hole 65 of the exterior sash 64, thus locking the door. When the runner pin 67A is held by the deadlock zone 86A of the runner pin notch 86, the deadlock pin 63 is also held fast by the deadlock zone channel 57A of the deadlock pin notch 57, thus securely locking the cam 62. Further, due to the action of the coil spring 68A, the cam 62 rotates smoothly.

When the lock is unlocked, the key is inserted in the cylinder lock 1 and rotated in the opposite sense as that indicated above. The lower protrusion of the cam 45 comes into contact with the lower area of the holding ward 52A of the runner 48, thereby elevating it. Thus the runner pin 67A contacts the upper part of runner pin notch 86 and rotates the locking bar 85 clockwise. As this happens, it rotates the hook 62 counterclockwise and releases its hold on the exterior sash 64.

Figure 16:
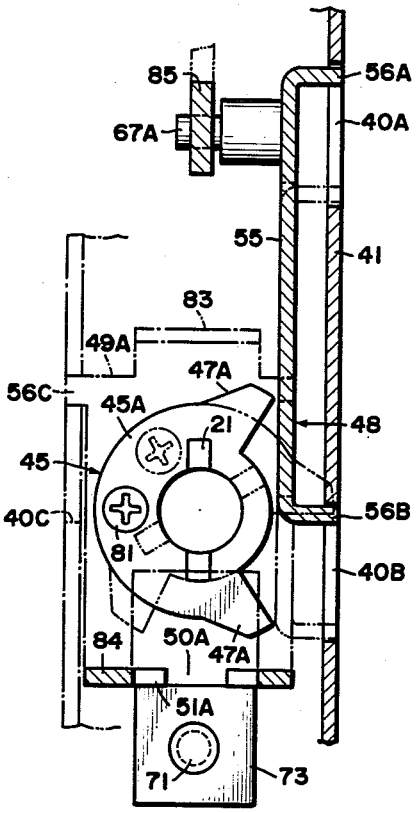
FIG. 16 is a cross-sectional view of the FIG. 15 taken along lines 16—16.
Figure 17:
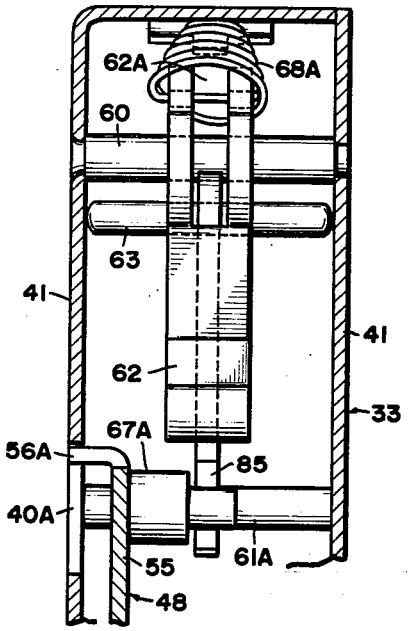
FIG. 17 is a rear view of the hook and the locking bar as shown in FIG. 15.

The cam 45 is ordinarily in the neutral position indicated by the line in FIG. 16. When the key rotates, it causes the runner 48 to slide.

The operation of the slide catch 82 shall now be described.

When the trigger 69 is disengaged and the slide catch 82 slides down as a guide along the bent piece slide channel 77A, the runner 48 moves downward and locks, as shown above. When it slides upward, the runner 48 moves upward and unlocks the lock.

The above description of the embodiments was for two-panel sliding doors, but it need not be limited to these, and can also be applied to sliding doors having three or more sections.

This design, as we noted earlier, consists of a lock with an ultra-thin cylinder lock which has a rotor, a rotating cam linked with the rotation of the cylinder lock, a runner with forward and backward motion linked to the rotation of the cam, a hook which has a deadlock zone and moves in concert with the back and forth movement of the runner, and a driver which is linked to the runner and moves it back and forth. Thus, where the frames of the sliding door meet, this design can provide a thin lock acceptable to the sash frame, and can provide a lock with both convenience and security.

I claim:

1. A lock assembly for sliding doors comprising:

a. a cylindrical lock having a rotor case and a rotor, said rotor having pin members disposed circumferentially about said rotor and configured such that upon insertion of an associated key into said rotor, said pin members retract and said rotor is rendered selectively rotatable in said rotor case;

b. a movable runner coupled to said rotor, said runner having a slot, said slot having a free-zone channel and a deadlock channel;

c. a rotatable hook member coupled to said runner, said hook member having a pin member configured such that when said hook member is in the unlocked position, said pin member fits into said free-zone channel, and when said hook member is in the locked position, said pin member fits into said deadlock channel; and d. a driving means movable disposed and coupled to said hook member, whereby said hook member is rotatable by manually actuating said driving means.

2. The lock assembly of claim 1 wherein said rotor has a cam, said cam coupling said runner to said rotor.

3. The lock assembly of claim 2 wherein said runner has a second slot, said driving means is a thumb turn bar having a pin member disposed thereon which is engaged by said second slot whereby rotation of said bar causes said pin member to shift said runner and to rotate said hook member selectively into said locked or unlocked position.

4. A lock assembly for sliding doors comprising:

a cylindrical lock having a rotor case and a rotor, said rotor having pin members circumferentially disposed about said rotor and configured such that upon insertion of an associated key into said rotor, said pin members retract and said rotor is rendered selectively rotatable in said rotor case;

a movable runner coupled to said rotor, said runner having a slot, said slot having a free-zone channel and a deadlock channel;

a cam, said cam coupling said runner to said rotor;

a rotatable hook member coupled to said runner, said hook member having a pin member configured such that when said hook member is in the unlocked position, said pin member fits into said free-zone channel, and when said hook member is in the locked position, said pin member fits into said deadlock channel;

a driving means movably disposed and coupled to said hook member, whereby said hook member is rotatable by manually actuating said driving means; and a trigger member movably coupled to said lock and extending outwardly therefrom, said trigger member having a movable seat member which engages in opening of said runner to prevent said runner from moving when said door is inappropriately situated for locking.

5. A lock assembly for sliding doors comprising:

a cylindrical lock having a rotor case and a rotor, said rotor having pin members circumferentially disposed about said rotor and configured such that upon insertion of an associated key into said rotor, said pin members retract and said rotor is rendered selectively rotatable in said rotor case;

a movable runner coupled to said rotor, said runner having a slot, said slot having a free-zone channel and a deadlock channel;

a cam, said cam coupling said runner to said rotor;

a rotatable hook member coupled to said runner, said hook member having a pin member configured such that when said hook member is in the unlocked position, said pin member fits into said free-zone channel, and when said hook member is in the unlocked position, said pin member fits into said deadlock channel; and a driving means movably disposed and coupled to said hook member, said driving means comprising a locking bar interposed between said runner and said hook member, and a slide catch coupled to said runner, whereby said hook member is rotatable by manually sliding the runner with said slide catch causing said locking bar to transform the vertical movement of said runner into the rotating movement of said hook member.

* * * * *